United States Patent [19]

Nakagawa

[11] Patent Number: 5,018,398

[45] Date of Patent: May 28, 1991

[54] ENGINE STARTER WITH A PINION SHIFTER UNIT

[75] Inventor: Taiichi Nakagawa, Himeji, Japan

[73] Assignee: Mitsubishi Denki Kabushiki Kaisha, Tokyo, Japan

[21] Appl. No.: 466,566

[22] Filed: Jan. 17, 1990

[30] Foreign Application Priority Data

Jan. 18, 1989 [JP] Japan ..... 1-9012

[51] Int. Cl.[5] ..... F02N 11/00

[52] U.S. Cl. ..... 74/7 R; 74/7 C; 74/7 E; 290/38 C; 290/48; 384/913

[58] Field of Search ..... 74/6, 7 R, 7 A, 7 E; 290/48, 38 C; 384/913

[56] References Cited

U.S. PATENT DOCUMENTS

| | | | |
|---|---|---|---|
| 3,171,284 | 3/1965 | Scherzinger | 74/7 R |
| 3,985,408 | 10/1976 | Bierlein et al. | 384/912 X |
| 4,304,140 | 12/1981 | Ebihara | 74/7 R |
| 4,334,926 | 6/1982 | Futamura et al. | 384/913 X |
| 4,613,761 | 9/1986 | Yabunaka | 290/36 R |
| 4,855,610 | 8/1989 | Morishita et al. | 74/7 A X |
| 4,868,407 | 9/1989 | Isozumi et al. | 290/48 |
| 4,896,551 | 1/1990 | Minami et al. | 74/7 E X |
| 4,899,603 | 2/1990 | Isozumi et al. | 74/7 A X |

FOREIGN PATENT DOCUMENTS 15766 1/1989 Japan .

OTHER PUBLICATIONS

Mark's Standard Handbook for Mechanical Engineers, McGraw-Hill Book Company, Ninth Edition, 1987, pp. 6-90to 6-95.

*Primary Examiner*—Allan D. Herrmann
*Assistant Examiner*—David W. Laub
*Attorney, Agent, or Firm*—Sughrue, Mion, Zinn, Macpeak and Seas

[57] ABSTRACT

An engine starter comprises an elongated pinion shifter unit 23 axially slidably mounted on an output rotary shaft 21 coupled to a d.c. motor for rotation therewith, and includes a pinion 8 mounted at a first end of the unit and a unidirectional clutch 6 disposed at a second end. A first sleeve bearing 24 is disposed between the first end of the pinion shifter unit and the output rotary shaft, and a second sleeve bearing 25 is disposed between the second end of the pinion shifter unit and the output rotary shaft. The first and the second sleeve bearings are spaced apart from each other, and the first sleeve bearing is made of a material wear resistant under a relatively large load, such as an iron-based material, and the second sleeve bearing is made of a material wear resistant under a high speed rotation condition, such as a copper-based material. Either one of the first and second sleeve bearings may have an inner diameter slightly greater than an outer diameter of the output rotary shaft at the position supported by the one of the sleeve bearings, so that a smooth axial sliding movement of the pinion shifter unit along the output rotary shaft is allowed even when the output rotary shaft is bent.

7 Claims, 1 Drawing Sheet

ENGINE STARTER WITH A PINION SHIFTER UNIT

BACKGROUND OF THE INVENTION

This invention relates to an engine starter and, more particularly, to an engine starter with a pinion shifter unit for a vehicular internal combustion engine.

FIG. 1 illustrates a conventional engine starter for starting a vehicular internal combustion engine. The starter 1 shown in FIG. 1 comprises a front bracket 2 having a hollow cylindrical portion 2*a*. A pinion shifter unit 4 supported by a bearing 3 fitted on the inner circumference of the cylindrical portion 2*a* is axially slidably supported on an output rotary shaft 5 through a pair of sleeve bearings 11.

The pinion shifter unit 4 comprises a undirectional clutch 6, a shifter member 7 having integrally formed at its rear end (the left end as viewed in FIG. 1) an integral clutch inner member 6*a*, and a pinion 8 mounted at the front end of the shifter member 7 projecting from an opening in the front bracket 2. The pinion 8 is mounted on the shifter member 7 by straight splines formed at the outer circumference of the shifter member 7 and is biased in the forward direction by a compression spring 9 placed over the shifter member 7 between the outer step portion formed in the member 7 and the inner step portion of the pinion 8. The pinion 8 is prevented from falling off from the shifter member 7 by a stopper 10.

Two sleeve bearings 11 disposed between the inner circumference of the shifter member 7 and the outer circumference of the output rotary shaft 5 are axially separated from each other and allow the shifter member 7 to rotate and axially slide relative to the output rotary shaft 21. An axial forward movement of the pinion shifter member 7 relative to the output rotary shaft 5 is limited by a stopper ring 12 secured on the front end of the output rotary shaft.

Further, the engine starter comprises a shift lever 13 for axially moving the pinion shifter unit 4, an armature rotary shaft 14, a planetary speed reduction gear unit 15 having a plurality of planetary gears 15*a* in mesh with a sun gear 14*a* formed in the armature rotary shaft 14 for reducing the speed of rotation of the armature rotary shaft 14, and a solenoid switch 16 for rocking the shift lever 13 coupled at one end to an engagement ring 17 attached to a clutch outer member 6*b* of the unidirectional clutch 6 and for connecting an electric power source to a d.c. motor of the starter.

The engine starter 1 as above described, which is generally referred to as the overhang type, has such a general arrangement that the outer circumferential sliding surface of the shifter member 7 of the pinion shifter unit 4 slidably fitted over the output rotary shaft 5 is slidably supported by the bearing 3 securely fitted within the front bracket 2 so that the pinion 8 mounted at the front end of the pinion shifter unit 4 may be moved into and out of engagement with an engine ring gear. In such an engine starter of the overhang type, an overhang dimension L or an axial dimension between the mounting surface 18 of the front bracket 2 at which the starter is attached to the engine and the front end of the pinion 8 when it is in an inactivated position is about 60 mm, and no overhang dimension greater than this is known to the applicant. With the overhang dimension L of the order of this length, there is substantially no problem of bending of the output rotary shaft 5 due to the load thereon. Therefore, both of two sleeve bearings 11 disposed between the shifter member 7 and the output rotary shaft 5 are made of a copper-based material in view of durability against a high-speed relative rotation.

However, a very wide variety of types of vehicles in recent years demands an engine in which the dimension between the engine surface on which a starter is to be mounted and the ring gear is equal to or more than 70 mm, whereby a starter of "super-long overhang type" having the above-mentioned overhang dimension L greater than 70 mm is required to be developed. However, when the starter output rotary shaft as well as the shifter member is made longer, it is difficult to manufacture a straight shaft, and the shaft bends relatively easily when a large load is exerted, thus posing problems in that the output rotary shaft is worn easily and the smooth sliding movement of the shifter member is impeded.

SUMMARY OF THE INVENTION

Accordingly, one object of the present invention is to provide an engine starter with a pinion shifter unit free from the above discussed problems of the conventional engine starter.

Another object of the present invention is to provide an overhang-type engine starter which has a relatively long overhang dimension and still is decreased in the wear of sleeve bearings and the output rotary shaft.

Another object of the present invention is to provide an overhang-type engine starter which has a relatively long overhang dimension and still is ensured a smooth movment of the shifter member.

Still another object of the present invention is to provide an overhang-type engine starter which has a relatively long overhang dimension and still is reduced in the wear of the sleeve bearings and the output rotary shaft and ensured a smooth movement of the shifter member.

With the above objects in view, an engine starter of the present invention comprises an elongated pinion shifter unit axially slidably mounted on an output rotary shaft coupled to a d.c. motor for rotation therewith, and a solenoid switch for operating the d.c. motor and shifting the pinion shifter unit. The pinion shifter unit includes a pinion mounted at a first end of the unit and a unidirectional clutch disposed at a second end of the unit. The engine starter also comprises a first sleeve bearing disposed between the first end of the pinion shifter unit and the output rotary shaft, and a second sleeve bearing disposed between the second end of the pinion shifter unit and the output rotary shaft. The first and the second sleeve bearings are spaced apart from each other, and the first sleeve bearing is made of a first material wear resistant under a load, such as an iron-based material, and the second sleeve bearing is made of a second material wear resistant under a high speed rotation condition, such as a copper-based material. Either one of the first and second sleeve bearings may have an inner diameter slightly greater than an outer diameter of the output rotary shaft at the position supported by the one of the sleeve bearings, so that a smooth axial sliding movement of the pinion shifter unit along the output rotary shaft is allowed even when the output rotary shaft is bent.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
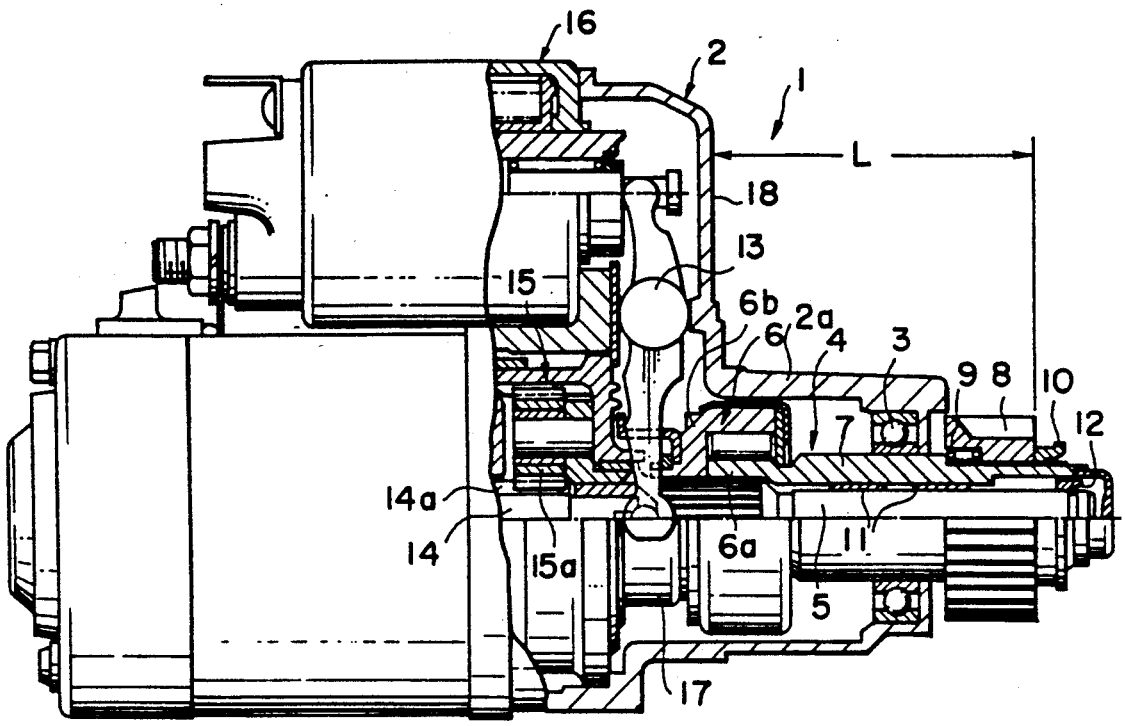
FIG. 1 PRIOR ART
FIG. 1 is a front view, partly in section, of a conventional overhang type engine starter to which the present invention can be applied.
Figure 2:
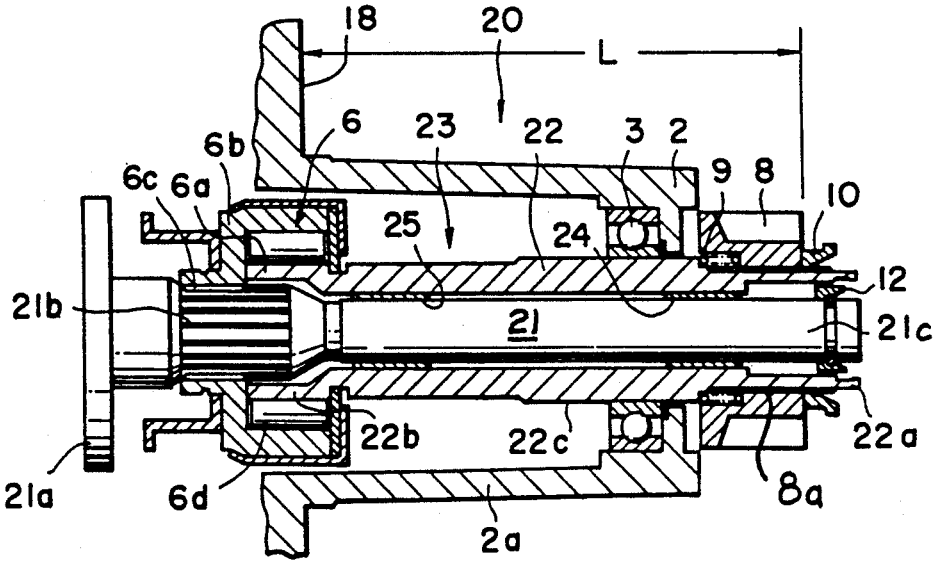
FIG. 2 is an enlarged fragmental sectional view of the overhand type engine starter of the present invention.

FIG. 2 illustrates only a portion of an overhang type engine starter 20 of one embodiment of the present invention in order to illustrate in detail a pinion shifter unit 23 to which the present invention is applied. Although FIG. 2 only illustrates the pinion shifter unit 23 and its immediately associated components, the engine starter of the present invention has a structure generally similar to that shown and described in conjunction with FIG. 1 except for the structure which will now be described in conjunction with FIG. 2. More specifically, the engine starter of the present invention comprises an electric motor having an armature rotary shaft connected to an output rotary shaft 21 through a planetary speed reduction gear and a solenoid switch for operating the motor and the pinion shifter unit 23.

Referring to FIG. 2, the output rotary shaft 21 has a rear end 21*a* connected to an armature rotary shaft of the d.c. motor through a planetary speed reduction gear as illustrated in FIG. 1. The rear end portion 21*a* of the output rotary shaft has formed therein splines 21*b* to which inner splines 6*c* of a clutch outer member 6*b* of a undirectional clutch 6 are axially slidably engaged for rotation together with the output rotary shaft 21. The front end 21*c* of the output rotary shaft 21 has a stopper ring 12 for preventing the pinion shifter unit 23 from dropping off the output rotary shaft 21.

The generally tubular elongated pinion shifter unit 23 has a first end having mounted thereon a pinion 8 and a second end mounted thereon the unidirectional clutch 6. The pinion shifter unit 23 comprises an elongated tubular shifter member 22 placed over the output rotary shaft 21 through a pair of spaced sleeve bearings 24 and 25. The shifter member 22 comprises a first end 22*a* and a second end 22*b* corresponding to the first and second ends, respectively, of the pinion shifter unit 23. The second end 22*b* of the shifter member 22 has an integral portion that serves as a clutch inner member 6*a* which, together with a plurality of rollers 6*d* disposed between the clutch outer member 6*b* and the clutch inner member 6*a*, constitutes the unidirectional clutch 6 for transmitting the rotation of the output rotary shaft 21 to the shifter member 22 while preventing the transmission of the rotation of the shifter member 22 back to the output rotary shaft 21. The first end 22*a* of the shifter member 22 has mounted thereon the pinion 8 through straight splines 8*a*, the compression spring 9 and the stopper 10.

An outer circumferential sliding surface 22*c* of the shifter member 22 between the pinion 8 and the unidirectional clutch 6 is slidably and rotatably supported by the inner circumference of a bearing 3 supported by a tubular support portion 2*a* of a front bracket 2 of the starter 20.

The first sleeve bearing 24 is disposed between the first end 22*a* of the pinion shifter member 22 and the output rotary shaft 21, and the second sleeve bearing 25 is disposed between the second end 22*b* of the pinion shifter member 22 and the output rotary shaft 21.

According to the present invention, the first and the second sleeve bearings 24 and 25 are spaced apart from each other by a relatively long distance because the overhang dimension L is as large as about 70 mm or more. The first sleeve bearing 24 is made of a first material wear resistant under a load, such as an iron-based material, and the second sleeve bearing 25 is made of a second material wear resistant under a high speed rotation condition, such as a copper-based material.

Also, either one of the first and second sleeve bearings 24 or 25 has an inner diameter slightly greater than an outer diameter of the output rotary shaft at the position at which it is supported by the one of the sleeve bearings 24 and 25. In one preferred embodiment of the present invention, the second sleeve bearing 25 has an inner diameter that is slightly greater than the outer diameter of the output rotary shaft 21 at the position where the second sleeve bearing 25 is supported. The inner diameter of the first sleeve bearing 24 is "equal" to the output rotary shaft 21 in the sense that the first sleeve bearing 24 can be smoothly slidably and rotatably fitted over the output rotary shaft 21 to allow a proper movement of the pinion shifter unit 23. Thus, the inner diameter of the second sleeve bearing 25, which is slightly greater than the outer diameter of the output rotary shaft 21, can be said also to be slightly greater than the inner diameter of the first sleeve bearing 24. Alternatively, the first sleeve bearing 24 may be made to have an inner diameter slightly greater than the outer diameter of the output rotary shaft 21.

With the arrangement as above described, when the solenoid switch is turned on, the d.c. motor (not shown) is energized to rotate and the shift lever (not shown) moves the pinion shifter unit 23 forward to cause the pinion 8 mounted on the shifter member 22 to engage with a ring gear of an engine (not shown) to rotate and start it. During the time period after the engine has been started and until the pinion 8 disengages from the engine ring gear, a large load is exerted to the pinion 8 and therefore to the front end portion 22*a* of the shifter member 22 due to a pulsating motion of the engine.

While this load is transmitted to the front or the first sleeve bearing 24, since the first sleeve bearing 24 is made of an iron-based material which exhibits a superior resistivity against wear due to a heavy load, the wear of the sleeve bearing 24 relative to the output rotary shaft 21 is significantly reduced. Also, since the rear or the second sleeve bearing 25 which is subject to a load lesser than that on the first sleeve bearing 24 is made of a copper-based material which exhibits a superior resistivity against wear due to a high speed rotation, the wear of the second sleeve bearing 25 is small.

On the other hand, in an overhang type engine starter such as illustrated in FIG. 2 having a very long overhang dimension L exceeding 70 mm for example, since the output rotary shaft 21 is relatively easily bent by the load exerted thereon and also since such the long output rotary shaft 21 is very difficult to manufacture with a desired strict straightness, the output rotary shaft 21 becomes out of coaxial alignment relationship during its rotation. With the overhang type engine starter 20 with a long overhand dimension L, since the pinion shifter unit 23 is supported by the first and the second sleeve bearings 24 and 25 spaced apart from each other relative to the output rotary shaft 21, the pinion shifter unit 23 cannot move smoothly along the output rotary shaft 21 when a slight eccentricity is experienced by the output rotary shaft 21.

According to the present invention, however, since either one of the first and second sleeve bearings 24 or 25 has an inner diameter slightly greater than an outer diameter of the output rotary shaft 21 at the position at which it is supported by the one of the sleeve bearings 24 and 25, a smooth movement of the pinion shifter unit 23 along the output rotary shaft 21 is ensured even when the output rotary shaft 21 is not straight for any reason such as a bent due to the load on it and/or the poor straightness at the time of manufacture, thereby reducing the wear of the sleeve bearings 24 and 25 as well as the output rotary shaft 21.

What is claimed is:

1. An engine starter comprising:

an electric motor connected to an output rotary shaft (21);

an elongated pinion shifter unit (23) axially slidably mounted on said output rotary shaft for rotation therewith and including a pinion (8) mounted at a first end and a unidirectional clutch (6) disposed at a second, opposite end;

a solenoid switch for operating said electric motor and shifting said pinion shifter unit;

a first sleeve bearing (24) disposed between said first end of said pinion shifter unit and said output rotary shaft; and a second sleeve bearing (25) disposed between said second end of said pinion shifter unit and said output rotary shaft;

said first and said second sleeve bearings being axially spaced apart from each other, said first sleeve bearing being made of a first material exhibiting superior wear resistance under heavy load conditions, and said second sleeve bearing being made of a second material exhibiting superior wear resistance under high speed rotation conditions.

2. An engine starter as claimed in claim 1, wherein said first material comprises an iron-based material and said second material comprises a copper-based material.

3. An engine starter as claimed in claim 1, wherein one of said first and second sleeve bearings has an inner diameter slightly greater than an outer diameter of said output rotary shaft at a position supported by said one of said sleeve bearings, thereby allowing a smooth axial sliding movement of said pinion shifter unit even when said output rotary shaft is bent.

4. An engine starter as claimed in claim 3, wherein said one of the bearings is the second sleeve bearing.

5. An engine starter as claimed in claim 3, wherein said one of the bearings is the first sleeve bearing.

6. An engine starter as claimed in claim 1, wherein said output rotary shaft has a splined portion formed therein, and said pinion shifter unit comprises an elongated shifter tube placed over said output rotary shaft and having a first and a second end corresponding to said first and second ends of said pinion shifter unit, said unidirectional clutch comprises a clutch outer member having a splined portion engaged with said splined portion of said output rotary shaft for rotation therewith while allowing an axial sliding movement thereon, a clutch inner member connected to said second end of said shifter tube for rotation therewith and a plurality of rollers disposed between said clutch outer member and said clutch inner member.

7. An engine starter comprising:

an electric motor connected to an output rotary shaft (21);

an elongated pinion shifter unit (23) axially slidably mounted on said output rotary shaft for rotation therewith and including a pinion (8) mounted at a first end and a unidirectional clutch (6) disposed at a second, opposite end;

a solenoid switch for operating said electric motor and shifting said pinion shifter unit;

a first sleeve bearing (24) disposed between said first end of said pinion shifter unit and said output rotary shaft; and a second sleeve bearing (25) disposed between said second end of said pinion shifter unit and said output rotary shaft;

one of said first and second sleeve bearings having an inner diameter slightly greater than an outer diameter of said output rotary shaft at a position supported by said one of said sleeve bearings, thereby allowing a smooth axial sliding movement of said pinion shifter unit even when said output rotary shaft is bent.

* * * * *